United States Patent [19]

Cofer

[11] Patent Number: 4,528,915

[45] Date of Patent: Jul. 16, 1985

[54] PORTABLE SHELVING

[76] Inventor: Theodore Cofer, 413 Willow Brookway, Voorhees, N.J. 08043

[21] Appl. No.: 487,272

[22] Filed: Apr. 21, 1983

[51] Int. Cl.[3] ..... A47B 9/00

[52] U.S. Cl. ..... 108/108; 108/111; 108/149

[58] Field of Search ..... 108/108, 149, 111, 33, 108/41

[56] References Cited

U.S. PATENT DOCUMENTS

| | | | |
|---|---|---|---|
| 2,244,887 | 6/1941 | Manley | 108/149 X |
| 3,199,473 | 8/1965 | Smith | 108/108 X |
| 3,340,829 | 9/1967 | Palmer | 108/149 |
| 3,799,072 | 3/1974 | Slaboden | 108/149 X |
| 4,400,043 | 8/1983 | Rossow | 108/149 X |

*Primary Examiner*—Kenneth Downey

[57] ABSTRACT

Portable shelving, which is readily assembled and disassembled, includes a foldable backing having a plurality of standards mounted thereto and having means to permit it to be attached to a surface of a structure. The standards include means for receiving a plurality of brackets for holding shelves thereon at different selected heights. The backing including the attached standards, in its disassembled condition, is foldable to enclose the brackets and shelves to provide a portable package. Means are included on the brackets to movably secure them to the shelves when they are packaged.

6 Claims, 4 Drawing Figures

FIG. 1
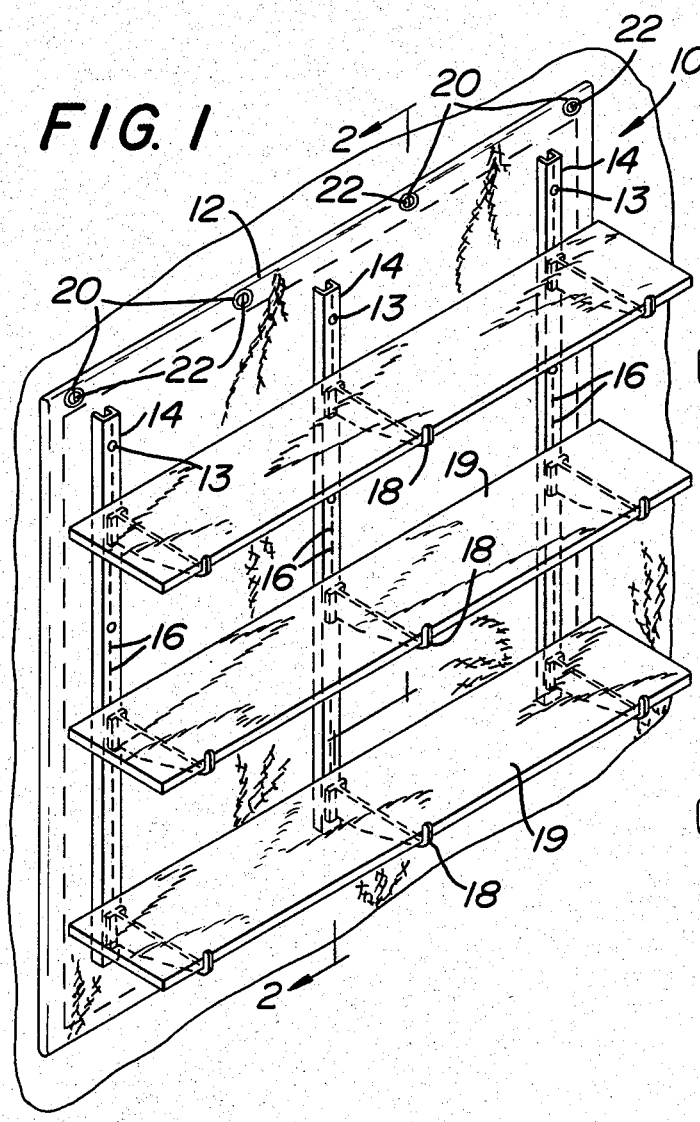
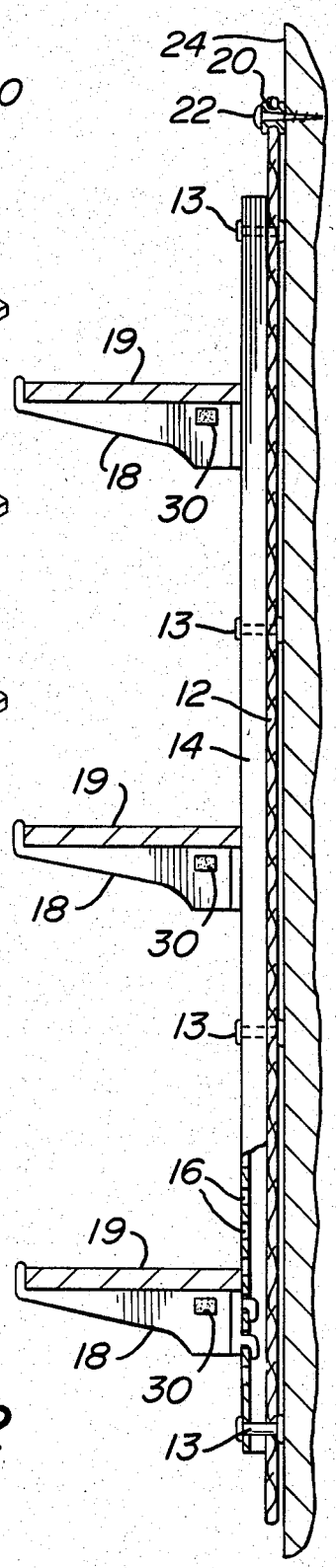
FIG. 2

PORTABLE SHELVING

BACKGROUND OF THE INVENTION

Shelving has taken a wide variety of different forms. One such form of shelving involves the use of standards designed to be mounted to a wall or wood surface. The standards have included a plurality of aligned vertically spaced openings to receive and hold brackets therein at selected heights. Shelves are then placed on the brackets. Generally, the standards are mounted by screws to wall beams inside a wall or held in place by means of molly bolts.

In many situations, it is desirable to have temporary shelving which is easily and quickly assembled and disassembled. Also, it is often that such temporary shelving be portable and readily carried from one place to another without the liklihood of losing some of parts involved. Examples of persons likely to make use of temporary portable shelving include campers and persons working outdoors. Also, military personnel who are on the move often have to set up and disassemble shelving for temporary use for short periods of time.

Other uses for temporary shelving involve office shelving, shelving for mobile salt items, uses in trade shows, street vending, tool workshops, vacation lodges, temporary displays and numerous other situations.

OBJECTS OF THE INVENTION

It is an object of this invention to provide novel portable shelving which may quickly be assembled and disassembled.

It is a further object of this invention ot provide improved portable shelving which may be used in a variety of different environments.

It is still a further object of this invention to provide improved portable shelving which may be readily carried with a minimum liklihood of losing any parts.

It is still a further object of this invention to provide improved portable shelving which may be quickly assembled and disassembled without special tools.

It is still a further object of this invention to provide a self contained lightweight and convenient carrying case for all the parts included in a portable shelving arrangement.

It is still a further object of this invention to provide improved portable shelving which is relatively easy to assembly and disassembly and which may be manufactured relatively inexpensively.

BRIEF SUMMARY OF THE INVENTION

In accordance with the present invention, portable shelving which may be readily assembled and disassembled quickly is provided. A heavy canvas includes mounting grommets to permit it to be secured to a structure by means of screws or pigboard hooks. Standards are permanently secured to the canvas to receive brackets for holding shelves thereon. In a disassembled condition, the canvas with the secured standards may be folded to provide a self contained package for the loose brackets and shelves. Means are provided to temporarily secure the brackets to the shelves when they are packaged to minimize the liklihood of loss during transit.

Other objects and advantages of the present invention will be apparent and suggest themselves to those skilled in the art from a reading of the following specification and claims, taken in conjunction with the accompanying drawings.

DESCRIPTION OF THE DRAWINGS

FIG. 1 is an isometric view of portable shelving, in accordance with the present invention;

FIG. 2 is a cross sectional view taken along lines 2—2 of FIG. 1;

DESCRIPTION OF THE INVENTION

Figure 3:
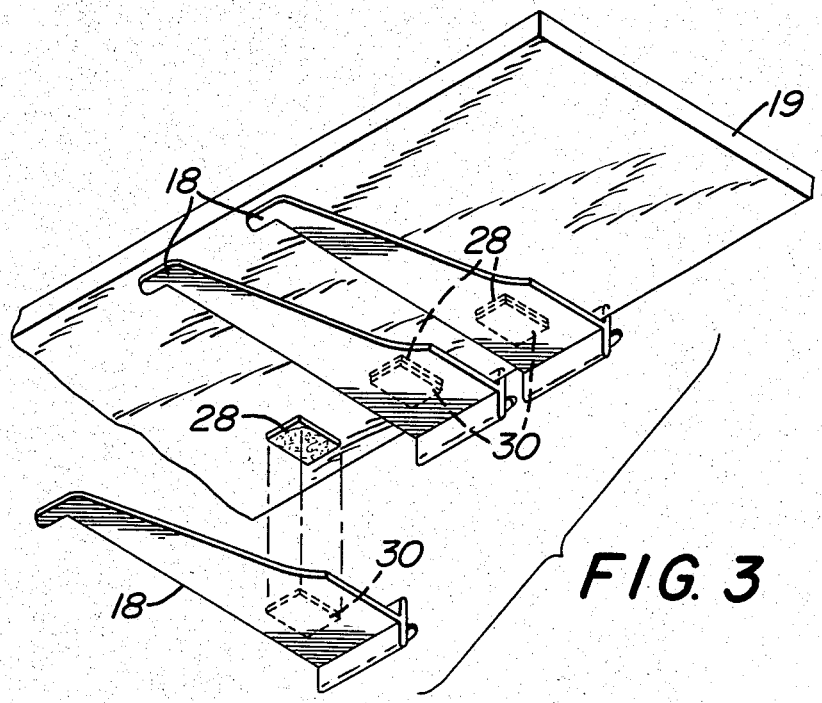
FIG. 3 is an enlarged isometric view illustrating means for temporarily securing the brackets to the shelves when they are disassembled from the backing during transit.

Referring to the drawings, a portable shelving assemble 10 includes a rectangular foldable backing 12, which may be a piece of material comprising heavy canvas reinforced at the edges. A plurality of standards, disposed to be mounted vertically, are permanently secured to the backing 12 at the desired heights and spacing by means of rivets 13 which extend through the standards 14, and backing 12 in the manner illustrated in FIG. 2.

The backing 12, which may be heavy type canvas as used in outdoor tents and the like or a heavy plastic material, includes a plurality of spaced metal grommets 20. The grommets include the openings to permit the backing 12 to be mounted to a surface of a structure as the first step in assembling the shelving 10.

The standards are of a conventional design and include a plurality of aligned spaced openings 16. A plurality of brackets 18, also of conventional design, are adapted to fit into selected openings in the standards at different desired selected heights. After the brackets 18 have been positioned in the stardards 14, a plurality of shelves 19 may be placed on the brackets to complete the assembly.

Figure 4:
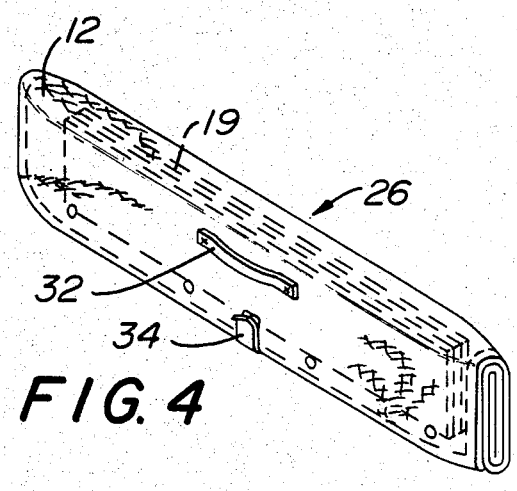
FIG. 4 is an isometric view of the backing forming a package containing all of the elements of the shelving illustrated in FIG. 1.

Prior to installing the shelving 10, the backing 12 with the standards 14 provide a package for the brackets 18, shelves 19 and other miscellaneous items if desired. This package 26 is illustrated in FIG. 4, which will be subsequently decribed.

When the package 26 is opened and unfolded to a flat position, the brackets 18 and shelves are removed and the backing 12 is ready to be mounted to a surface of a structure. As illustrated in FIG. 2, screws 22 may be inserted through the openings in the grommets 20 to secure the backing 12 to wall studs 24, only one of which is illustrated. The brackets 18 are then inserted into the selected openings 16 in the standards 14 at the desired heights. Shelves 19 are then supported on the brackets 18. In some cases, pegboard hooks or other fastening means may be used to receive the grommets 20 to hold the backing 12.

A convenient embodiment of the present invention has included the grommets 20 being spaced 16 inches apart to correspond to the spacing between many conventional wall studs. The canvas backing 12 may be 50"×50", with three standards and nine brackets being provided.

An important feature of the present invention involves the manner in which the brackets 18 and shelves 19 are temporarily secured together when the shelving assembly 10 is packaged in the package 26 to be carried from one site to another.

Referring to FIG. 3, the underside of each of the shelves 19 include three pieces of Velcro material 28 adherred thereto. Three of the brackets associated with each of the respective shelves 19 also include pieces of Velcro material 30 adherred thereto. The pieces 30 of the brackets 18 may be attached to the pieces 28 on the shelves 19 when the shelving is disassmbled. The Velcro material comprises a commercially available cloth material having large numbers of closely spaced relatively stiff fiber elements extending therefrom.

Velcro material is sold commercially by Velcro USA, Inc., 406 Brown Ave., Manchester, N.H. 03108

When one piece of Velcro material is pressed against another peice, the short elements extending therefrom extend into each other causing adherence between the pieces. Thus in the present invention, Velcro material provides a convenient means for temporarily securing the brackets 18 to the shelves 19 when they are in the package 26. Thus the liklihood of losing one of the brackets during transit is minimized.

Referring to FIG. 4, the package 26 including the backing 12 is folded to enclose the brackets 18 and shelves 19. A carrying handle 32 is secured to the folded package 26. A hood and loop flexible piece of material 34 is provided to hold the package 26 enclosed. The piece 34 is permanently secured to one part of the backing 12 and disposed to extend loosely around the edges of folded portions of the package 12. The flexible material 34 may include a piece of Velcro material adherred on one side thereof disposed to engage a piece of material adherred to a portion of the backing 12 to maintain the package 26 closed. The package 26 is easily opened by pulling the hook and loop piece of material 34.

The various number of standards, shelves, grommets illustrated may be varied in accordance with design requirements. Dimensions given are merely illustrative. In some cases, attachment means other than Velcro may be employed.

In situations in which the loads to be held by the shelves 19 are relatively light, the backing or canvas may include an adhesive material to permit attachement to a wall or other structure without penetrating the wall and permit it to be separated therefrom by manually pulling the backing from the wall. In some cases, vacuum or Velcro elements may be employed.

What is claimed is:

1. A kit for providing portable shelving for mounting to a surface of a structure, comprising:

a. a piece of foldable material;

b. a plurality of standards secured to said material having openings therein adapted to receive a plurality of brackets;

c. means secured to said material to permit said material with said standards to be movably mounted to the surface of said structure;

d. a plurality of brackets adapted to be secured to said standards in positions extending perpendicularly therefrom to receive shelves thereon with said standards providing the sole supports for said brackets and shelves;

e. a plurality of rigid shelves adapted to rest on said brackets;

f. fastening means on said brackets to permit temporary attachment to said shelves when said kit is disassembled; and g. said piece of foldable material with said standards being foldable to enclose said brackets and shelves to provide a portable package when said kit is disassembled.

2. A kit as set forth in claim 1 wherein said fastening means comprises a material attached to said shelves and said brackets.

3. A kit as set forth in claim 2 wherein said brackets include a plurality of spaced openings for receiving said brackets wherein.

4. A kit as set forth in claim 3 wherein said foldable material comprises relatively heavy canvas material.

5. A kit as set forth in claim 4 wherein said standards are riveted to said canvas material.

6. A kit as set forth in claim 5 wherein said means secured to said canvas for mounting to said structure comprises a plurality of equally spaced grommets.

* * * * *